US006435918B1

(12) United States Patent
Chen

(10) Patent No.: US 6,435,918 B1
(45) **Date of Patent: *Aug. 20, 2002**

(54) REDUCED RETURN LOSS ELECTRICAL CONNECTOR

(75) Inventor: Michael Chen, Taipei (TW)

(73) Assignee: Surtec Industries Inc., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/664,362

(22) Filed: Sep. 18, 2000

(51) Int. Cl.[7] ..... H01R 24/00; H01R 9/22; H01R 13/73

(52) U.S. Cl. ..... 439/676; 439/941

(58) Field of Search ..... 439/676, 344, 439/941, 638, 460; 333/1, 12

(56) References Cited

U.S. PATENT DOCUMENTS

| | | | | | |
|---|---|---|---|---|---|
| 4,800,236 | A | * | 1/1989 | Lemke | 174/36 |
| 5,547,405 | A | * | 8/1996 | Pinney et al. | 439/894 |
| 5,599,209 | A | * | 2/1997 | Belopolsky | 439/676 |
| 5,938,479 | A | * | 8/1999 | Paulson et al. | 439/676 |
| 5,941,734 | A | * | 8/1999 | Ikeda et al. | 439/676 |

* cited by examiner

*Primary Examiner*—Khiem Nguyen
*Assistant Examiner*—Chandrika Prasad
(74) *Attorney, Agent, or Firm*—Birch, Stewart, Kolasch & Birch, LLP

(57) ABSTRACT

An electrical connector, capable of reducing return loss, includes a case, a wiring base, four pairs of contacts and a bottom piece. Three pairs of contacts are fixed by the wiring base and the bottom piece. Another pair of contacts is mounted on the bottom side of the bottom piece. The contacts can further be formed into a necked portion to improve communication performance. The electrical connector has a simpler construction to be easily fabricated. It reduces attenuation, near-end cross talk and return loss, and meets the Category 5e, EIA/TIA standard.

18 Claims, 8 Drawing Sheets

REDUCED RETURN LOSS ELECTRICAL CONNECTOR

BACKGROUND OF THE INVENTION

1. Field of Invention

The present invention generally relates to an electrical connector applied to transmit electrical signals, and more particularly relates to an electrical connector which can reduce the return loss caused by reflections in the communication system, enhance transmission performance, and meet the EIA/TIA, Category 5e, standard.

2. Related Art

Information transmissions through network communication are recently more and more popular. The applications are getting wider. As a demand, the high speed and high efficiency transmissions require high quality cabling and connectors. Generally, the network communication paths are composed of transmission media and electrical connectors. On the transmission media, there are twisted pair cables, coaxial cables, and optical fibers. Certain defects occur in the communication path which will worsen as the frequency of signals gets higher. The defects may come from:

1) attenuation of signal. The level of signal decreases when the transmission distance increases;

2) cross talk, which is induced by electromagnetic interference between closely spaced cables or contacts; and 3) return loss, which is caused by reflections in the communication system due to the discontinuous impedance.

Taking unshielded twisted pair (UPT) cabling for example, the cable includes two isolated copper wires twisted with a certain pitch and a certain manner. A pair or two pairs of twisted cables constitute a communication chain as a simplest transmission medium. The twisted pairs are commonly used in computer communication networks. But, in their connecting hardware, cross talk is induced due to capacitive and inductive couplings between adjacent conductors. As the frequency of the signal increases, the magnitude of the cross talk is especially increased logarithmically, and the impedance also increases, which badly distort the high frequency signals.

For the aforesaid reasons, the EIA/TIA 568 standard established by Electronic Industries Association has been adopted into IEEE 802.3 u standard by the Institute of Electrical and Electronics Engineers, Inc. The IEEE 802.3 u standard includes all the standards for the transmission medium and connectors, and classifies them into several categories.

For example, "Category 3" are network cabling for voice which use solid copper wires of 24 AWG with impedance 100Ω and certifies UTP for data transmission up to 10 Mbps; "Category 4" are the same as Category 3 but with data transmission up to 16 Mbps; "Category 5" are the same as Category 3 but with data transmission up to 10 Mbps. Another category with tighter requirements than Category 5 is "Category 5e" which requests for a limited extent of return loss caused by reflections in the communication system due to the discontinuous impedance. The following tables A and B are standards of maximum return loss for cable and for connectors according to the EIA/TIA Category 5e standard.

TABLE A

Maximum return loss for cable

| Frequency (MHz) | Return loss (dB) |
|---|---|
| $1 \leqq f < 10$ | $20 + 5*\log(f)$ |
| $10 \leqq f < 20$ | 25 |
| $20 \leqq f \leqq 100$ | $25 - 7*\log(f/20)$ |

TABLE B

Maximum return loss for connectors

| Frequency (MHz) | Return loss (dB) |
|---|---|
| $1 \leqq f < 18$ | 35 |
| $18 \leqq f \leqq 100$ | $20 - 20*\log(f/100)$ |

An exploded view of a unitary electrical connector of prior arts is shown in FIG. 1. The electrical connector mainly includes a case 10, a wiring base 12, a plurality of contacts 20 and a bottom piece 13. One end of the case 10 is formed with a wiring portion 16, while the other end is a socket 18 for terminal plug of communication wires. The plurality of contacts 20 are fixed by the wiring base 12 and the bottom piece 13, and engaged into the wiring portion 16 to be a composed unit in the case 10. Each of the contacts 20 is a metallic member 22 having one end 23 sharply bent and inserted into socket 18 as contacts; and the other end 28 bent with a right angle and formed as a fork for receiving a communication wire. Some of the members 22 are formed with holes 24 to be engaged with extrusions 26 formed on the bottom piece 13 and fixed by the wiring base 12 and the bottom piece 13. Each of the forks is a slot with an expended opening and a round end for receiving and fixing the unshown communication wire.

The wiring base 12 is made of electrically isolative material and formed with a plurality of wire guides 121 and separated slots 122 in the middle of the guides 121 for fixing the fork ends 28 of the contacts 20 therein. The contacts 20 are therefore mounted from the bottom of the wiring base 12 and fixed by the bottom piece 13. Finally, the composed unit is inserted into the wiring portion 16 of the case 10 and fixed together.

As described above, the unitary electrical connector is composed of wiring base 12, contacts 20, bottom piece 13 and case 10. The contacts 20 are located in a plane and bent with ends for contacting with signal source, and other ends for connecting communication wires. The layout of the contacts 20 will influence the performance of the communication.

A prior invention, referred to Taiwanese application Serial NO. 089201829, Filed Feb. 1, 2000, by the same inventor of the present invention is to improve the wiring by two metallic wires for reducing the return loss. The two wires go through the bottom piece from the top side to the bottom side and exposes with a first and a second wire portions on the top side which contact with the third and the sixth contact members when the wiring base, the contacts and the bottom piece are assembled. The two wires further go respectively under the bottom side of the bottom piece and go beyond the fourth and fifth contact members, then return to the topside as a third and a fourth wire portions to contact with the third and the sixth contact members at portions near the sharply bent ends. These by-pass loops will reduce return loss. But both ends of the wires have to be passed through the bottom piece and bent, they are hard to be fabricated.

SUMMARY OF THE INVENTION

It is therefore an object of the present invention to provide an electrical connector which can improve communication quality for higher frequency transmission and meet the requirement of Category 5e in EIA/TIA standard.

To achieve the aforesaid objects, an electrical connector capable of reducing return loss according to the present invention includes a case, a wiring base, four pairs of contacts and a bottom piece. One end of the case is formed with a wiring portion, while the other end is a socket for terminal plug of communication wires. The first pair or the third pair of contacts and the other three pairs of contacts are mounted on different sides of the bottom piece. The wiring base, the pairs of contacts and the bottom piece are composed into the case to form a unit which can solve the problem of worsen attenuation, cross talk and return loss in high frequency transmission.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
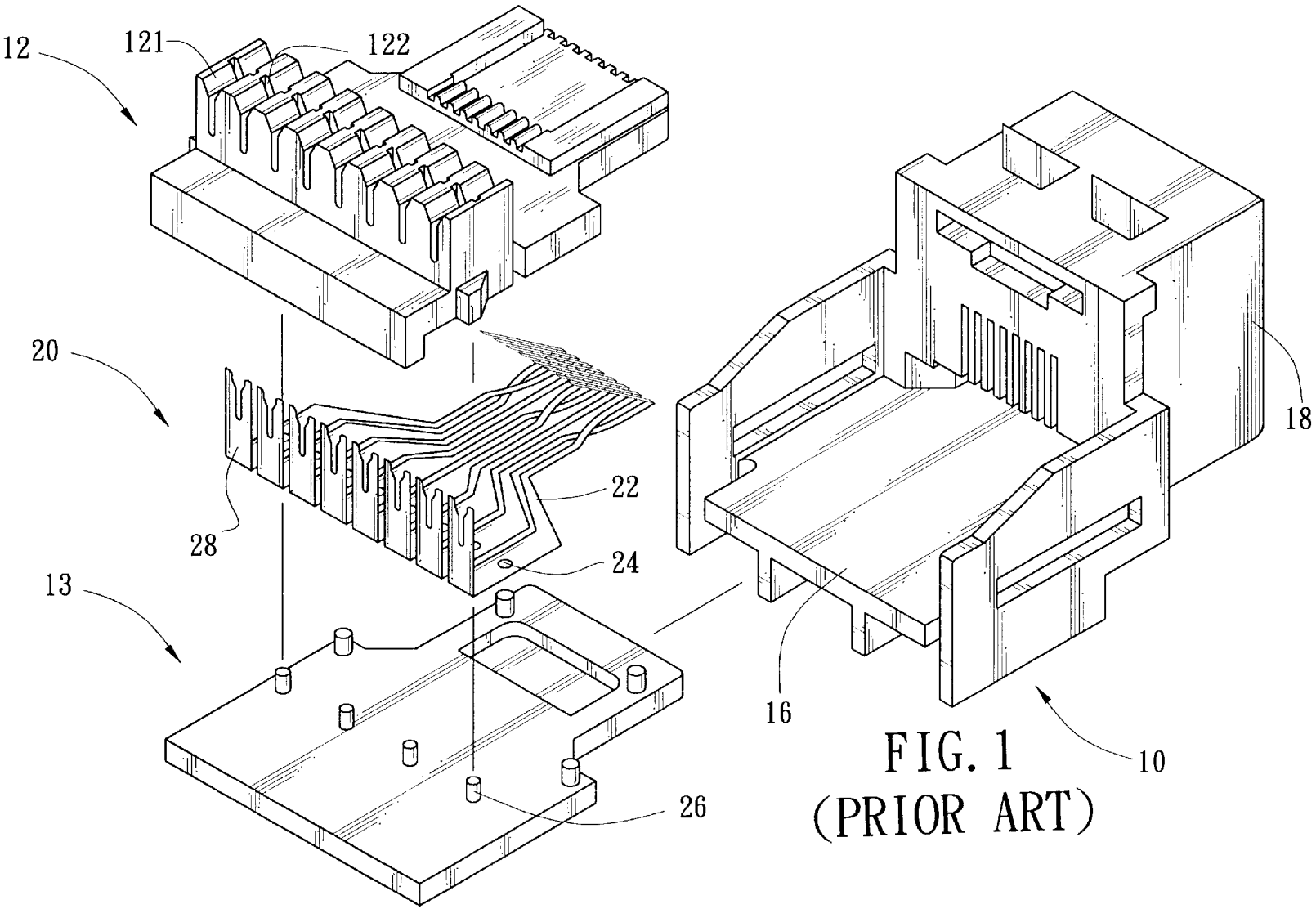
FIG. 1 (PRIOR ART)
FIG. 1 is an exploded view of a unitary electrical connector of prior arts.

A unitary electrical connector of prior arts is described above with FIG. 1.

Now referring to FIGS. 2, 6, 7 and 8, an electrical connector capable of reducing return loss according to the present invention includes a case 10, a wiring base 15, four pairs of contacts 41, 42, 43, 44, 45, 46, 47, 48; and a bottom piece 14. One end of the case 10 is formed with a wiring portion 16, while the other end is a socket 18 for terminal plug of communication wires. The wiring base 15, the pairs of contacts 41~48 and the bottom piece 14 are composed into the case 10 to form a unit.

Figure 5:
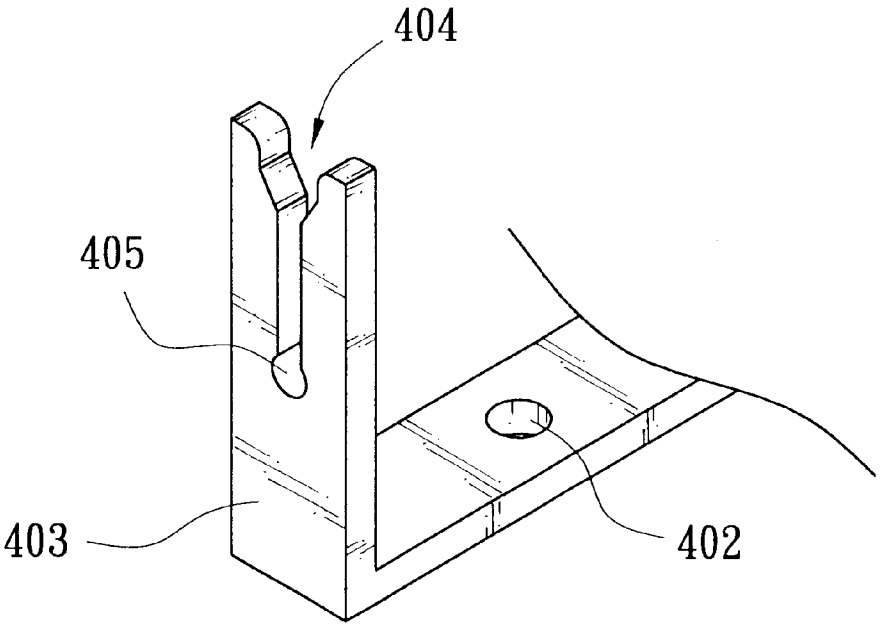
FIG. 5 is a partial enlarged view of a wiring fork of a contact in the present invention.

Each contacts 41~48 is a metallic member 401 formed with a sharply bent end to be inserted into the socket 18 to serve as a contact for a terminal plug of communication wires. Each of the contacts 42, 43, 46, 47 is formed with a hole 402 to be engaged with extrusions 141 formed on the bottom piece 14. The other end 403 of each member 401 is bent upward and formed with a fork for receiving and fixing a communication wire. A detailed illustration of the fork portion is shown in FIG. 5, which shows that the fork is a slot formed on the end 403 with an expended opening 404 and a round bottom 405. The shape of the fork makes the unshown communication wire easily inserted from the opening and fixed in the bottom 405.

The wiring base 15 is made of electrically isolative material and formed with a plurality of wire guides 151 (six in the middle and two at the end as shown) and separated slots 152 in the middle of the guides 151 for fixing the fork ends 403 of the contacts 41~48 therein. The contacts 41~48 are therefore mounted from the bottom of the wiring base 15 and fixed by the bottom piece 16. Finally, the composed unit is inserted into the wiring portion 16 of the case 10 and fixed together.

In the cabling of EIA/TIA T 568B, for example, the first pair is contacts 44, 45; the second pair is contacts 41, 42; the third pair is contacts 43, 46; and the fourth pair is contacts 47, 48.

Figure 2:
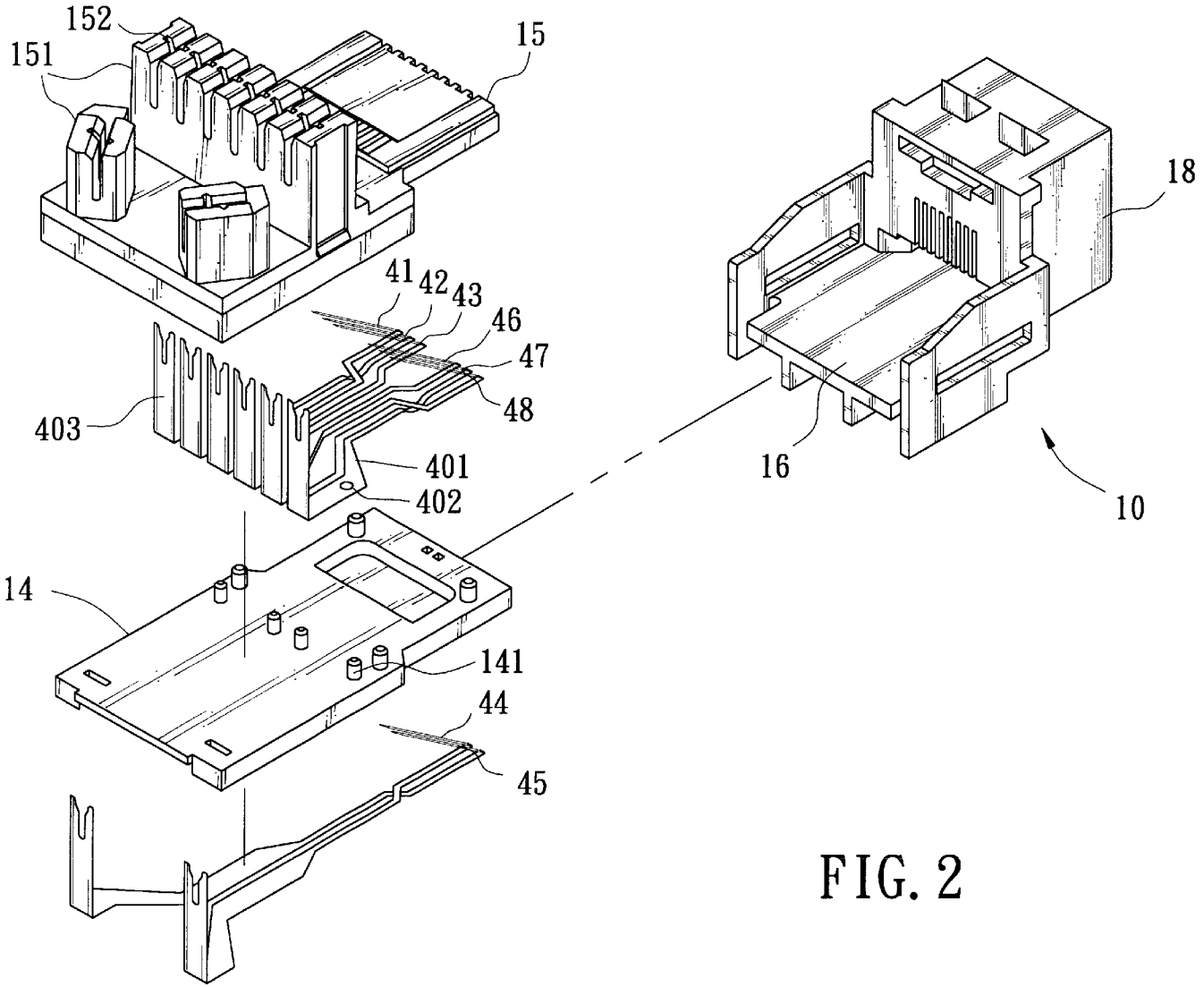
FIG. 2 is an exploded view of a unitary electrical connector according to the first embodiment of the present invention.
Figure 3:
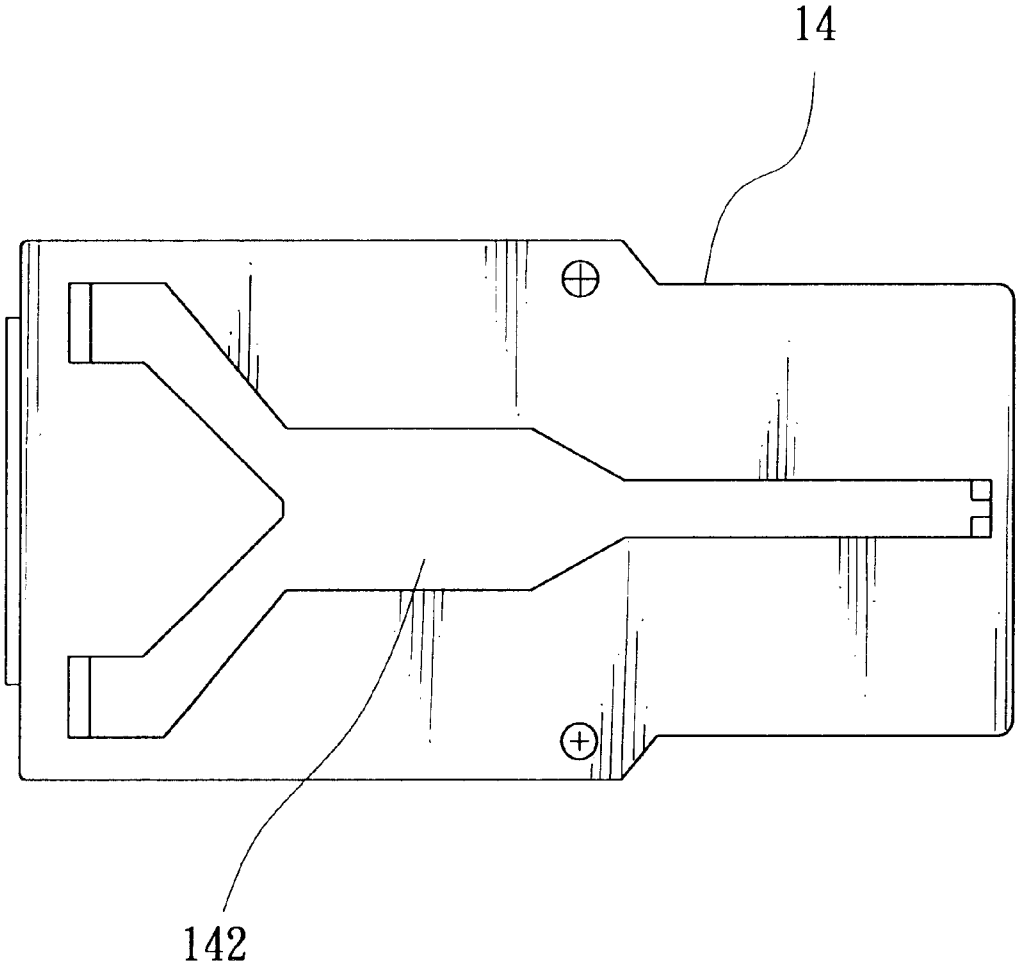
FIG. 3 is a bottom view of a bottom piece in the present invention.
Figure 4:
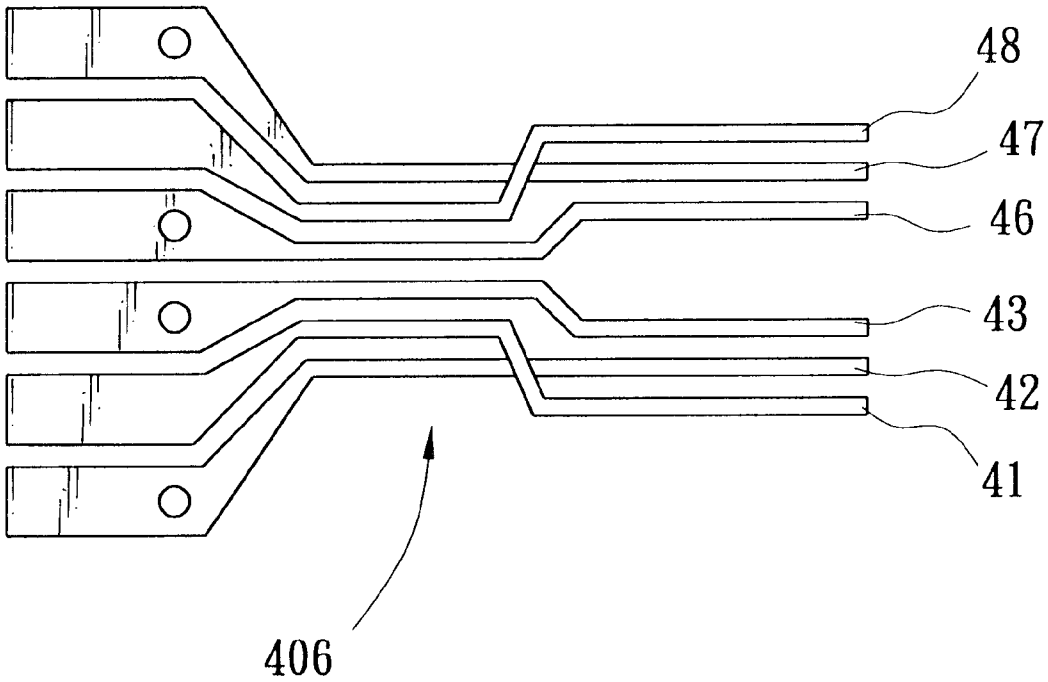
FIG. 4 is a plane view of a necked portion in three pairs of contacts in the present invention.

In order to reduce return loss and meet the standard of Category 5e, the first pair of contacts 44, 45 and the other three pairs of contacts 41, 42; 43, 46; 47, 48 are mounted on different sides of bottom piece 14. Referring to FIG. 2, the other three pairs of contacts 41, 42; 43, 46; 47, 48 are fixed between the bottom piece 14 and wiring base 15. The first pair of contacts 44, 45 is isolated by the bottom piece 14 and mounted on the bottom side of the bottom piece 14 by a positioning device such as pins or a groove 142, as shown in FIG. 3. Since the first pair of contacts 44, 45 has been moved to the bottom side of the bottom piece 14, the third pair of contacts 43, 46 can go closely so as to reduce return loss, as shown in FIG. 4. The other three pairs of contacts 41, 42; 43, 46; 47, 48 can further be formed into a necked portion 406 to increase compensation and improve the communication performance.

Figure 7:
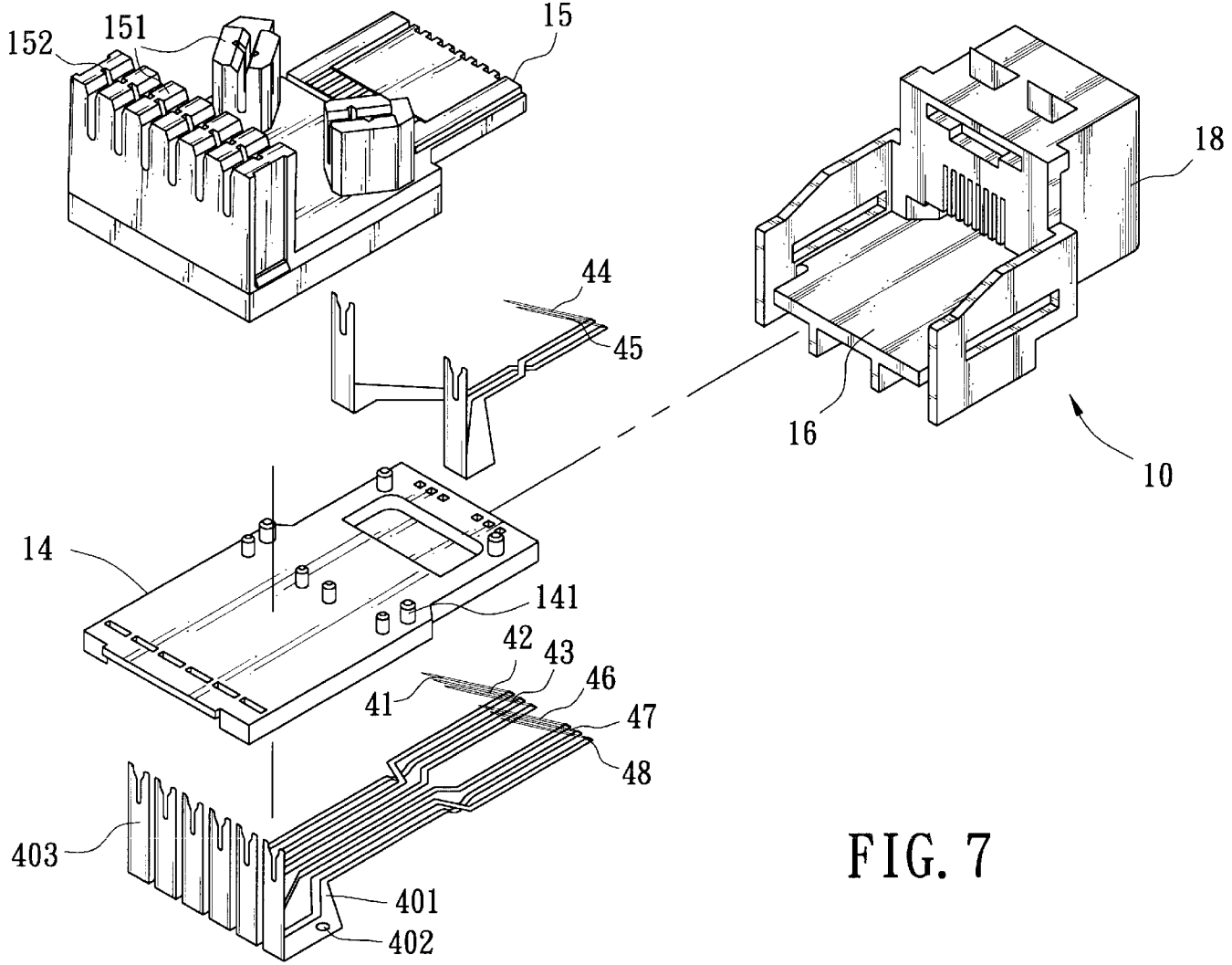
FIG. 7 is an exploded view of a unitary electrical connector according to the third embodiment of the present invention.

On the other hand, referring to FIG. 7, the first pair of contacts 44, 45 is fixed between the bottom piece 14 and wiring base 15. The other three pairs of contacts 41, 42; 43, 46; 47, 48 are isolated by the bottom piece 14 and mounted on the bottom side of the bottom piece 14 by a positioning device.

Figure 6:
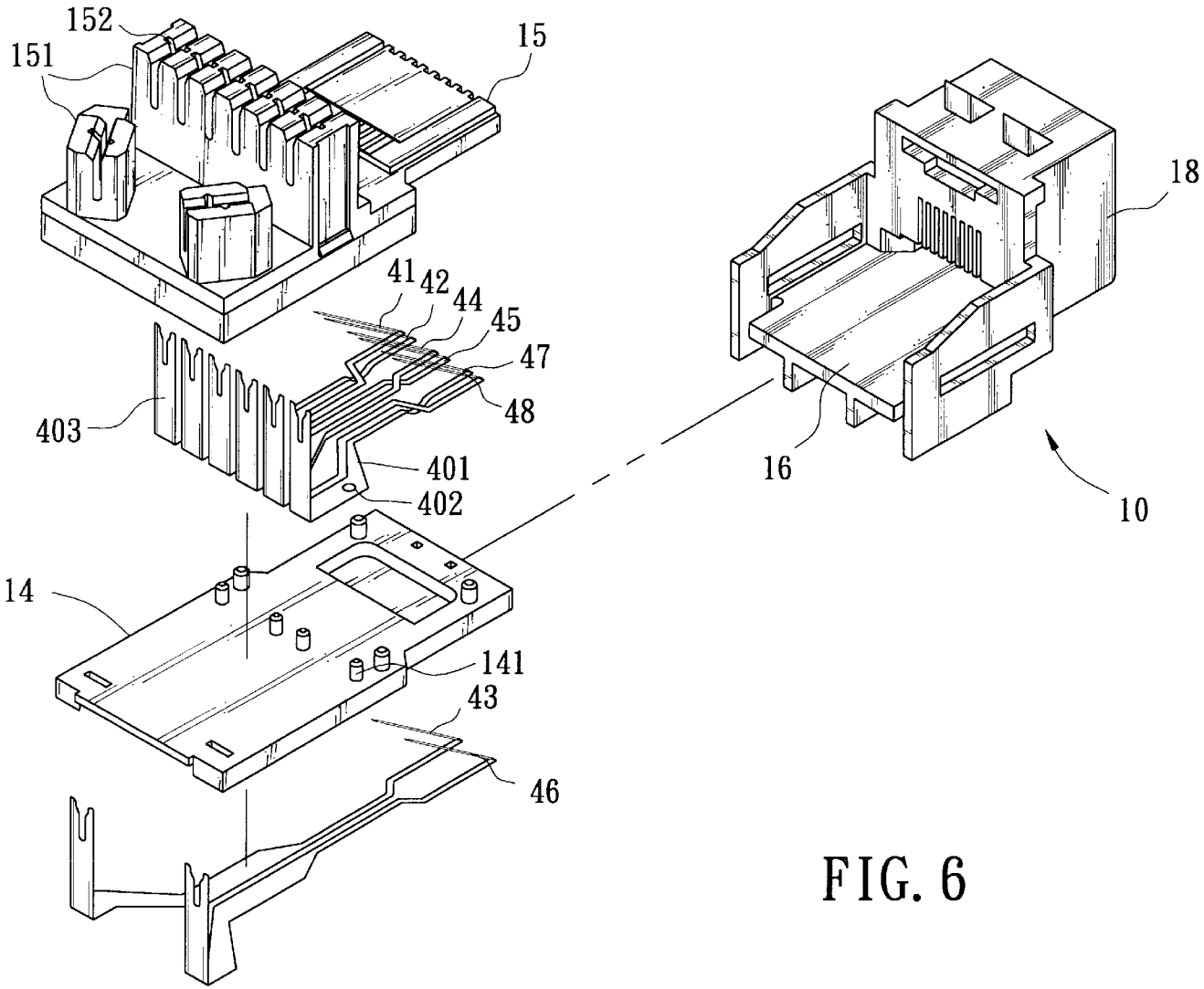
FIG. 6 is an exploded view of a unitary electrical connector according to the second embodiment of the present invention.

Referring to FIG. 6, the third pair of contacts 43, 46 and the other three pairs of contacts 41, 42; 44, 45; 47, 48 are mounted on different sides of bottom piece 14. The third pair of contacts 43, 46 is fixed between the bottom piece 14 and wiring base 15. The other three pairs of contacts 41, 42; 44, 45; 47, 48 are isolated by the bottom piece 14 and mounted on the bottom side of the bottom piece 14 by a positioning device.

Figure 8:
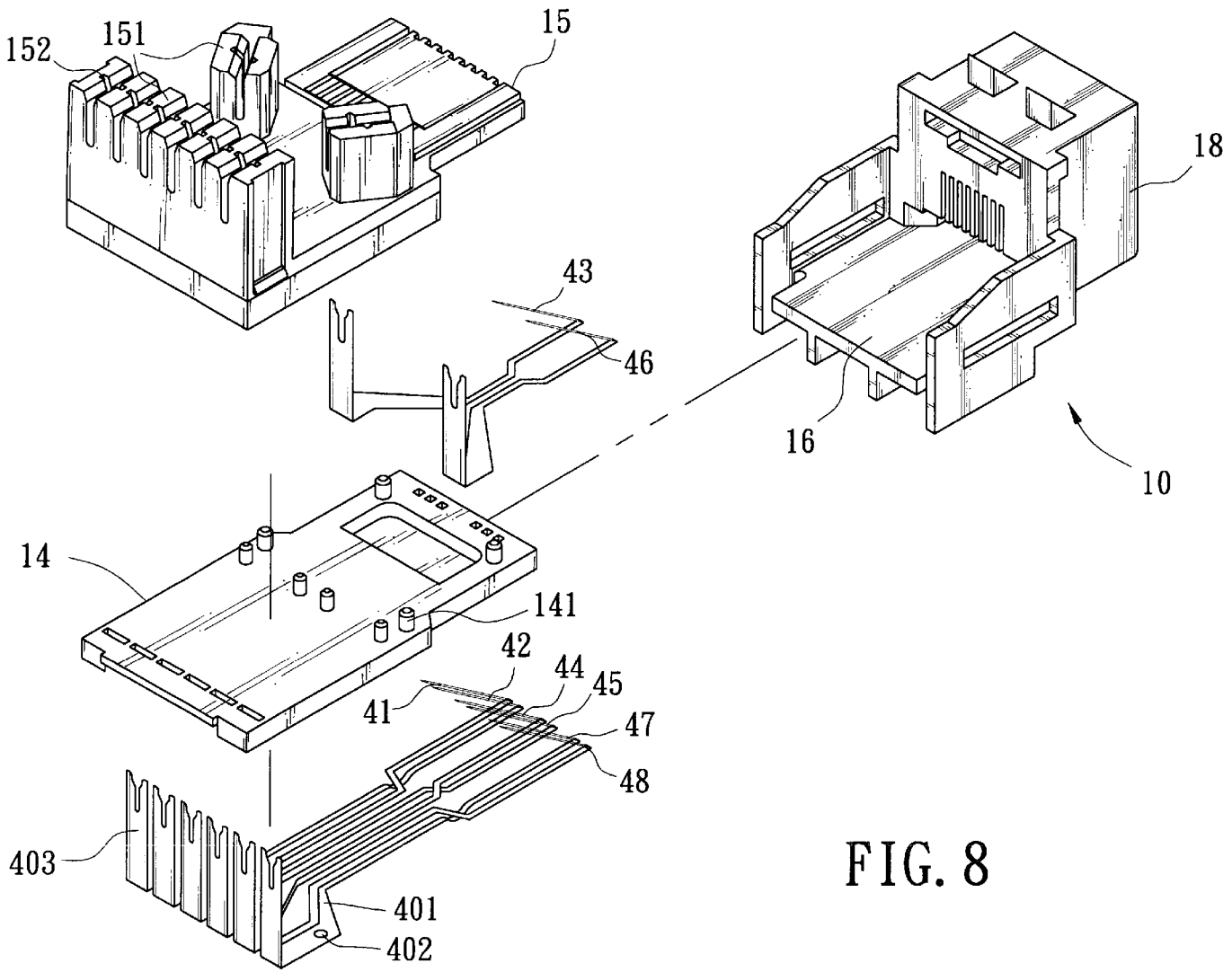
FIG. 8 is an exploded view of a unitary electrical connector according to the fourth embodiment of the present invention.

On the other hand, referring to FIG. 8, the third pair of contacts 43, 46 is fixed between the bottom piece 14 and wiring base 15. The other three pairs of contacts 41, 42; 44, 45; 47, 48 are isolated by the bottom piece 14 and mounted on the bottom side of the bottom piece 14 by a positioning device.

As described above, the electrical connector according to the present invention not only meets the requirements of Category 5e in EIA/TIA standard, but also prevents difficult wiring of the prior invention, therefore improving the manufacturing efficiency.

In conclusion, the present invention provides an electrical connector which has a simpler construction to be easily fabricated. It solves the problems of attenuation, near-end cross talk and return loss in prior arts, and meets the Category 5e, EIA/TIA standard.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector for reducing return loss, comprising:

a wiring base formed with eight isolative slots;

a bottom piece located under said wiring base;

a case having one end formed with a wiring portion and another end formed with a socket, the wiring portion receiving said wiring base and the bottom piece, the socket being for a terminal plug of a communication wire; and four pairs of contacts, each having one end fixed in one of said isolative slots and another end being bent and fixed into the socket of the case, the four pairs of contacts including a first pair and three other pairs of contacts, the first pair of the contacts being mounted on a different side of the bottom piece from the other three pairs of contacts, the first pair of contacts being directly beneath the other three pairs of contacts in a first plane and the other three pairs of contacts being in a second plane and the first and seconds planes fail to intersect and are spaced from one another such that the first pair of contacts and the other three pairs of contacts are positioned at different non-intersecting levels whereby cross talk can be reduced.

2. The electrical connector as recited in claim 1, wherein the other three pairs of contacts are fixed between said wiring base and the bottom piece and the first pair of contacts is isolated by the bottom piece.

3. The electrical connector as recited in claim 2, wherein the first pair of contacts is below the bottom piece while the other three pairs of contacts are above the bottom piece such that the bottom piece is between the first and other three pairs of contacts.

4. The electrical connector as recited in claim 2, wherein the bottom piece has a positioning device for mounting the first pair of contacts.

5. The electrical connector as recited in claim 4, wherein the positioning device comprises a groove formed in the bottom piece.

6. The electrical connector as recited in claim 1, wherein the other three pairs of contacts are formed into a necked portion with three different spacings between the other three pairs of contacts therefore being provided.

7. The electrical connector as recited in claim 1, wherein the bottom piece is flat.

8. The electrical connector as recited in claim 1, wherein the first pair of contacts are adjacent each other and wherein at least two of the other three pairs of contacts have bent ends which are adjacent one another.

9. The electrical connector as recited in claim 1, wherein the bent ends of the first pair of contacts are between the bent ends of one of the other three pairs of contacts.

10. An electrical connector for reducing return loss, comprising:

a wiring base formed with eight isolative slots;

a bottom piece located under said wiring base;

a case having one end formed with a wiring portion and another end formed with a socket, the wiring portion receiving said wiring base and the bottom piece, the socket being for a terminal plug of a communication wire; and four pairs of contacts, each having one end fixed in one of said isolative slots and another end being bent and fixed into the socket of the case, the four pairs of contacts including a first, second, third and fourth pairs of contacts, the third pair of contacts being mounted on a different side of the bottom piece from the first, second and fourth pairs of contacts, the third pair of contacts being in a first plane and the other three pairs of contacts being directly beneath the third pair of contacts in a second plane and the first and seconds planes fail to intersect and are spaced from one another such that the third pair of contacts and the other three pairs of contacts are positioned at different non-intersecting levels whereby cross talk can be reduced.

11. The electrical connector as recited in claim 10, wherein the other three pairs of contacts are fixed between said wiring base and the bottom piece and the third pair of contacts is isolated by the bottom piece.

12. The electrical connector as recited in claim 11, wherein the third pair of contacts is below the bottom piece while the other three pairs of contacts are above the bottom piece such that the bottom piece is between the third and other three pairs of contacts.

13. The electrical connector as recited in claim 11, wherein the bottom piece has a positioning device for mounting the third pair of contacts.

14. The electrical connector as recited in claim 13, wherein the positioning device comprises a groove formed in the bottom piece.

15. The electrical connector as recited in claim 10, wherein the other three pairs of contacts are formed into a necked portion with three different spacings between the other three pairs of contacts therefore being provided.

16. The electrical connector as recited in claim 10, wherein the bottom piece is flat.

17. The electrical connector as recited in claim 10, wherein a length of each of the third pair of contacts next to the bottom piece is adjacent to one other and wherein at least two of the other three pairs of contacts have bent ends which are adjacent one another.

18. The electrical connector as recited in claim 10, wherein the bent ends of the first pair of contacts are between the bent ends of the third pair of contacts.

* * * * *